US005126797A

United States Patent [19]

Forest et al.

[11] Patent Number: 5,126,797

[45] Date of Patent: Jun. 30, 1992

[54] METHOD AND APPARATUS FOR LAMINATING TONER IMAGES ON RECEIVING SHEETS

[75] Inventors: Paul H. Forest; Colleen D. McVeigh, both of Rochester; John S. Perlowski, Pittsford, all of N.Y.

[73] Assignee: Eastman Kodak Company, Rochester, N.Y.

[21] Appl. No.: 435,147

[22] Filed: Nov. 13, 1989

[51] Int. Cl.[5] ..... G03G 8/00; G03G 21/00

[52] U.S. Cl. ..... 355/278; 355/311

[58] Field of Search ..... 355/324, 325, 279, 278, 355/277, 280, 326, 327, 27; 430/277, 126, 99, 98; 156/308.2, 309.6, 566, 556, 568

[56] References Cited

U.S. PATENT DOCUMENTS

| | | | |
|---|---|---|---|
| 3,091,160 | 5/1963 | Crumrine et al. | 355/278 X |
| 3,788,930 | 1/1974 | Honjo et al. | 430/117 |
| 3,799,827 | 3/1974 | Takimoto et al. | 430/124 X |
| 3,813,267 | 5/1974 | Honjo et al. | 430/99 X |
| 3,833,293 | 9/1974 | Serio et al. | 355/278 X |
| 4,077,803 | 3/1978 | Gravel | 355/219 X |
| 4,178,096 | 12/1979 | Lontz | 355/32 |
| 4,287,285 | 9/1981 | Mosehauer | 430/126 X |
| 4,609,282 | 9/1986 | Crandall | 355/325 |
| 4,635,133 | 1/1987 | Nys et al. | 355/79 X |
| 4,681,428 | 7/1987 | Devoy | 355/325 X |
| 4,816,872 | 3/1989 | Okamoto et al. | 355/319 X |
| 4,857,961 | 8/1989 | Ogiso et al. | 355/27 |
| 4,920,382 | 4/1990 | Mills et al. | 355/326 X |
| 4,937,105 | 6/1990 | Sakai et al. | 430/126 X |

*Primary Examiner*—A. T. Grimley
*Assistant Examiner*—Nestor R. Ramirez
*Attorney, Agent, or Firm*—Leonard W. Treash, Jr.

[57] ABSTRACT

A toner image on a receiving sheet is laminated using a transparent laminating sheet fed from the normal copy sheet supply of a copier, printer or the like. The laminating sheet is fed into laminating contact with the toner image after the toner image has been formed on a receiving sheet. The resulting sandwich is fed through the fuser laminating the image between the sheets. The invention is particularly usable in forming color transparencies.

12 Claims, 3 Drawing Sheets

METHOD AND APPARATUS FOR LAMINATING TONER IMAGES ON RECEIVING SHEETS

TECHNICAL FIELD

This invention relates to laminating toner images on receiving sheets. The invention is especially useful for forming color transparencies that retain their desired color when projected.

BACKGROUND ART

Unfused color toner on transparent sheets has a tendency to scatter projection light rather than transmit it. The scattered light fails to reach the projection screen and the colored toner shows up as a grey image rather than the desired color. The conventional solution is thorough fusing of the color toner which greatly reduces the scattering and improves the projection. However, fusers that are ordinarily designed for use with paper copies do not adequately fuse color toners on transparency stock at the same speed and temperature that they fuse toners on paper.

Off-line lamination of toner images on receiving sheets, both transparent and opaque, has been used to reduce the scattering of images on transparent receiving sheets and protect images on opaque sheets.

United Kingdom Patent Application 2,150,885, published Jul. 10, 1985 suggests laminating toner images on a paper receiving sheet using the fuser of a copier. A transparent film is overlaid the toner image as the receiving sheet is fed into the fuser. The transparent film is a polyester having an acrylic resin which contacts the toner image, the resin has a melting point similar to that of the toner. This laminating process for protecting toner images on paper requires a separate supply mechanism for laminating material and appropriate hardware in the vicinity of the fuser.

Japanese Kokai 88/039439 and 88/039440 suggest putting a laminating sheet in contact with a printed surface of a printing sheet in the supply tray of a copier and feeding it all the way through the copy sheet path of the copier to laminate the two sheets. The two sheets are apparently placed in contact in the supply tray by hand.

DISCLOSURE OF INVENTION

It is the object of the invention to provide a method and apparatus for improving the quality of a toner image on a receiving sheet.

This and other objects are accomplished in a reproduction apparatus by feeding a transparent laminating sheet from a normal copy sheet supply portion of the reproduction apparatus into contact with a toner image on a receiving sheet to form a sandwich. The sandwich is then fed through the regular fuser of the apparatus to laminate the toner image between the two sheets.

According to a preferred embodiment the reproduction machine is a color reproduction machine which has a transfer drum to which a receiving sheet is attachable. An attached receiving sheet is circulated on the drum into transfer relation with one or more colored toner images to create a color image on the receiving sheet. A transparent laminating sheet is fed by a feeding means normally forming part of the copy sheet feeding path of the copier into contact with the receiving sheet while the receiving sheet is still associated with the transfer drum to form a sandwich. The sandwich is fed from the transfer station to the fuser.

According to another preferred embodiment a receiving sheet receives one or more toner images at the transfer station and is fed through the fuser. The copy sheet is then recirculated back through an ordinary duplex path of the reproduction apparatus to a position prior to the transfer station where it forms a sandwich with a transparent laminating sheet for refeeding through the transfer and fusing stations.

With this invention, lamination is accomplished in a copier using the normal copy sheet supply mechanisms and the normal copy sheet feeding mechanisms and without the need to overlay the sheets by hand.

BRIEF DESCRIPTION OF THE DRAWINGS

In the detailed description of the preferred embodiments of the invention presented below, reference is made to the accompanying drawings, in which.

BEST MODE OF CARRYING OUT THE INVENTION

Figure 1:
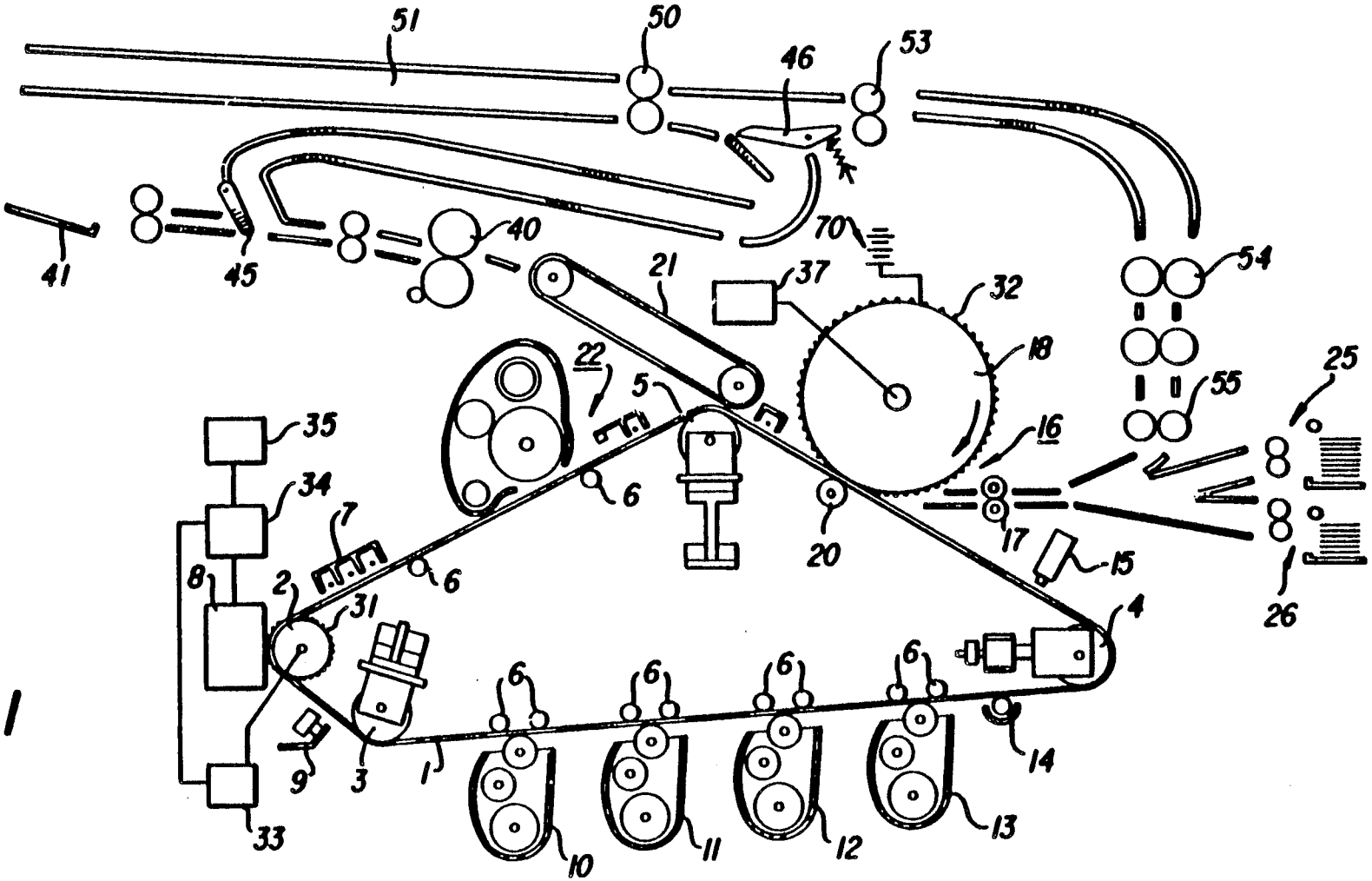
FIG. 1 is a schematic side view of color reproduction apparatus utilizing the invention.

According to FIG. 1 a film core portion of a copier or printer includes an image bearing member, for example, an endless electrophotoconductive web 1 mounted about a series of primary rollers 2, 3, 4 and 5, and other supporting structure, for example, film skis 6.

Web 1 is driven through a series of electrophotographic stations generally well-known in the art. More specifically, a uniform charge is laid down on the web 1 by a charging station 7. The uniformly charged web moves around printhead roller 2 which is directly opposite an LED printhead 8 which LED printhead exposes the web 1 in a manner well-known in the art. The web then moves into operative relation with an electrometer 9 which senses the level of charge existing after exposure of the web by printhead 8, to help control the process.

The web then moves into operative relation with a series of toning or developing stations 10, 11, 12 and 13. Each image created by printhead 8 is toned by one of the toning stations. After being toned the web passes a magnetic scavenger 14 which removes excess iron particles picked up in the toning process. After the electrostatic image has been toned the web passes under a densitometer 15 which measures the density of the toner image also for use in controlling the process. The toner image then proceeds to a transfer station 16 where the image is transferred to a receiving sheet carried by a transfer drum 18.

The transfer drum 18 includes vacuum holes for securing the receiving sheet for repeated presentations to web 1. The transfer drum 18 cooperates with web 1 to incrementally bring the receiving sheet and the toner image into transfer relation so that the toner image is transferred to the receiving sheet. As is well known in the art, this is generally accomplished in the presence of an electric field which is created by biasing the transfer drum by a suitable biasing means, for example, electrical source 70, compared to the conductive layer of the web 1 or to a backing roller 20 for the web. When the apparatus is operating in a multi-image mode, for example, a multicolor mode, consecutive images or pairs of images are toned with different colored toners using the different toning stations 10–13. These consecutive images are transferred in registry to the receiving sheet as it repeatedly is brought into transfer relation with the web 1 by the drum 18. After the transfer operation is complete, the receiving sheet is allowed to follow the web, for example, by removing the vacuum holding it to the drum 18 or by stripping the sheet with a skive, other conventional stripping mechanism, or both. The receiving sheet is separated from the web with the aid of an electrostatic sheet transport mechanism 21 and is transported to a fuser 40. The web is then cleaned by the application of a neutralizing corona and a neutralizing erase lamp and a magnetic brush cleaning mechanism all located at a cleaning station 22.

The transfer drum 18 is driven by a motor 37, the drum 18 in turn driving the web 1 through a sprocket 32 which engages performations in web 1. The sprocket 32 also forms part of a registration and timing system which includes a sprocket 31 on printhead roller 2 which sprocket is linked to an encoder 33. The encoder 33 feeds signals indicative of the angular position of sprocket 31 to a drive 34 for the printhead 8 which drive 34 times the application of information from an information source 35 to the printhead 8.

After the receiving sheet leaves the fuser 40 it can go directly to an output tray 41 or be deflected by a deflector 45 into a duplex path according to the position of deflector 45, the position of which is controlled by the logic of the apparatus through means not shown. The duplex path moves the sheet by rollers and guides directing it first through a passive deflector 46 into turn-around rollers 50. Turn-around rollers 50 are independently driven to drive the receiving sheet into turn-around guide means 51 until the trailing edge thereof has been sensed by an appropriate sensor, not shown, to have passed passive diverter 46. Once the trailing edge has passed passive diverter 46 the turn-around rollers 50 are reversed and the receiving sheet is driven by rollers 50 and other sets of drive rollers 52, 53, and 54 back to a position upstream of the transfer station 16. The receiving sheet can pass through registration mechanisms for correcting for skew, crosstrack misalignment and in-track misalignment and ultimately stop at alignment rollers 55.

Transfer station 16 receives sheets from any of three sources. First, it can receive sheets of one particular size from a first supply hopper 25, which first supply hopper may include, for example, letter size sheets being fed with their short dimension parallel with the direction of feed. Second, it may receive sheets from a second supply hopper 26, which, for example, may include ledger size sheets with their long dimension parallel to the direction of movement. These two supply hoppers 25 and 26 together constitute the copy sheet supply means of the apparatus. Third, the transfer station 16 may receive sheets from the duplex path as controlled by rollers 55 which may include either size sheet and would already contain a fused image on its upper side. The receiving sheets from whatever source, stop against timing rollers 17. In response to a signal from the logic and control of the apparatus, not shown, timing rollers 17 accelerate to drive the receiving sheet into the nip between the transfer drum 18 and the web 1 as the first toner image to be transferred approaches the nip.

The duplex path is of a length that takes multiple sheets at one time depending on the length of the sheets. For example, four letter size sheets may be in the duplex path at one time or two ledger size sheets. If the printer is printing different images on different sheets, the logic and control of the apparatus must supply the necessary programming to the exposure and toning stations so that the sheets ultimately fed to the output tray 41 are in the correct order considering the number of sheets that must be in the duplex path. Such programming is known in the art, see, for example, U.S. Pat. No. 4,453,841.

The above is an adequate description of the operation of the apparatus shown at FIG. 1 for making multicolor images on paper and black toner images on transparencies. However, as explained above, color images either monocolor or multicolor do not project well if given the same fusing that is adequate for black toner images on transparency stock or color images on paper.

Figure 2:
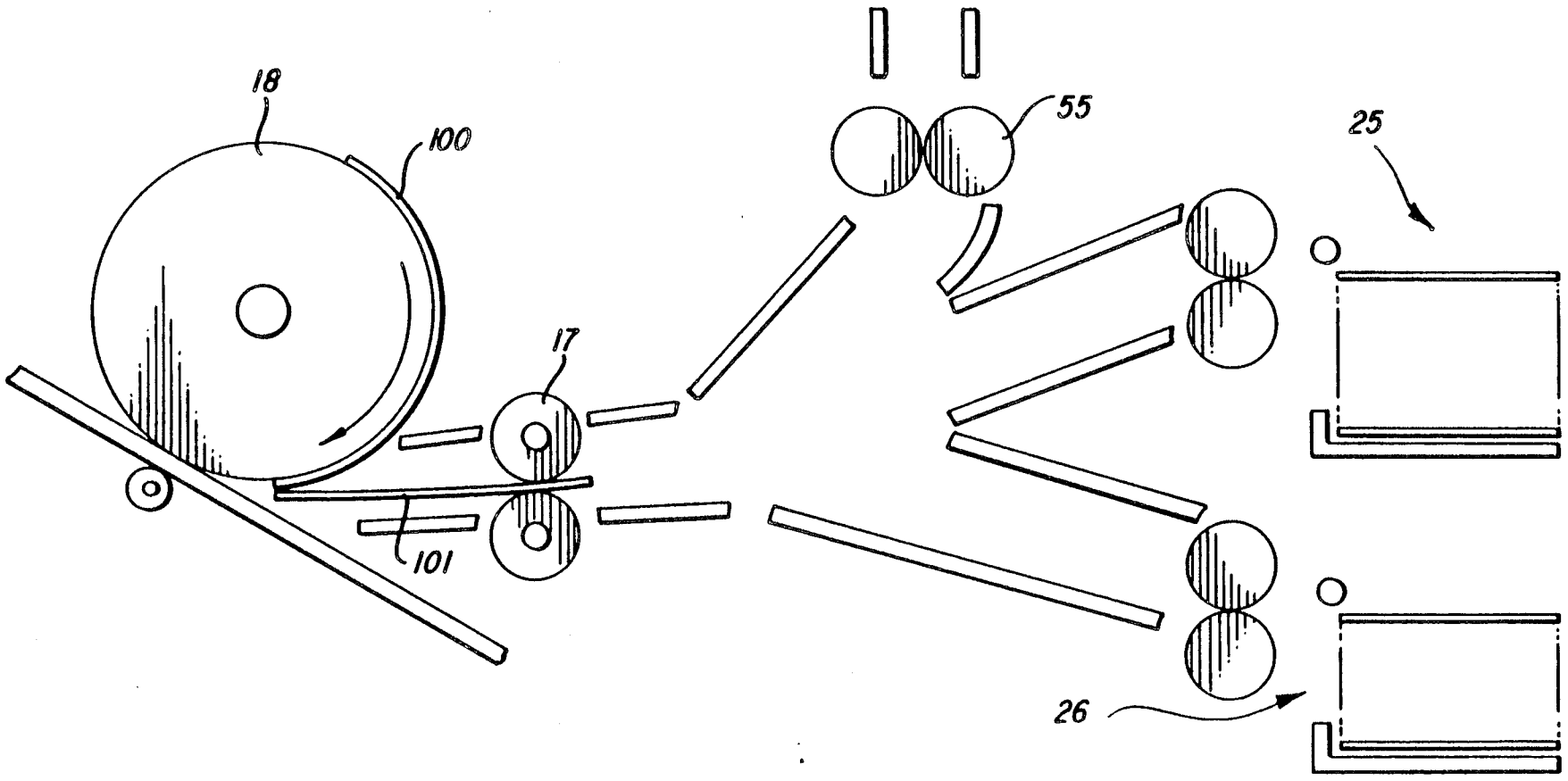
FIG. 2 is a schematic side view of the transfer portion of the reproduction apparatus of FIG. 1 illustrating a preferred embodiment of the invention.

FIG. 2 illustrates a preferred embodiment of the invention. According to FIG. 1 a receiving sheet, for example, a transparent receiving sheet 100. is fed out of either supply hopper 25 or supply hopper 26 and through timing rollers 17 and into contact with drum 18 to receive a toner image carried on image member 1. As seen in FIG. 2, receiving sheet 100 is secured to approximately one-half of the circumference of transfer drum 18 for repeated rotation into transfer relation with image bearing member 1 to receive a separate color toner image on its outside surface for each revolution of drum 18.

Meanwhile, a transparent laminating sheet 101 is fed from one of supply hoppers 25 or 26 to timing rollers 17. After the last image has been transferred to first receiving sheet 100, drum 18 makes an additional revolution and laminating sheet 101 is fed by timing rollers 17 into overlying contact with the toner image on receiving sheet 100 as shown in FIG. 2. The two sheets adhere to each other electrostatically, forming a sandwich, as they are fed back through the transfer nip, separated from the transfer roller and fed through the regular copy sheet path of the reproduction machine shown in FIG. 1 to fuser 40. As the two sheets pass through the fuser 40 they are laminated together. The resulting laminated sandwich provides good optical projection because the toner has at least partially fused to both surfaces greatly reducing the tendency of the toner to scatter projection light.

Figure 3:
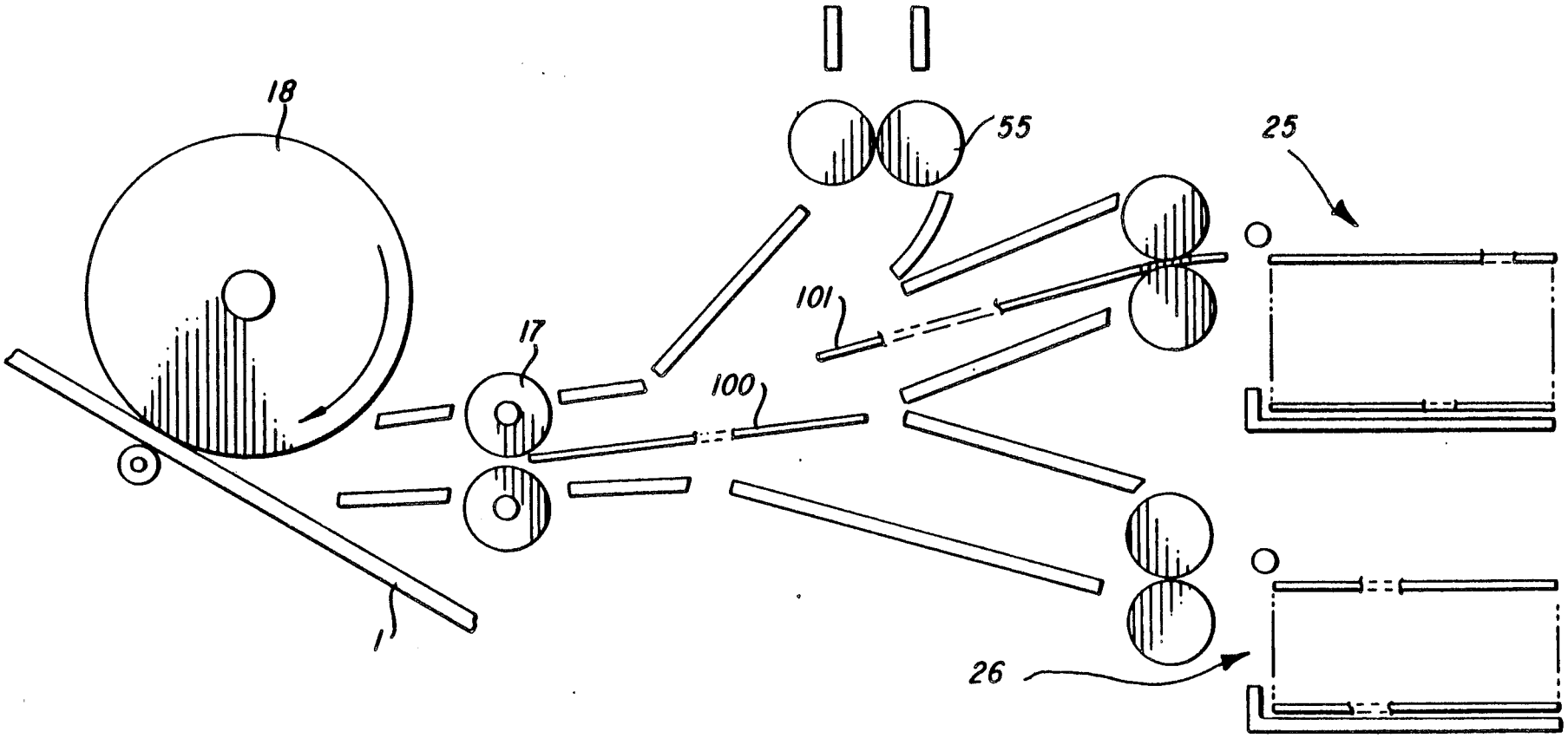
FIG. 3 is a schematic side view of the transfer portion of the color reproduction apparatus illustrated in FIG. 1, illustrating another preferred embodiment of invention.

FIG. 3 illustrates an alternative embodiment of the invention. Referring first to FIG. 1, the receiving sheet 100 is fed to the transfer station 16 where it receives a monocolor or multicolor toner image and is passed on to the fuser 40. At this point the receiving sheet 1 with a partially fused color image thereon is passed back through the duplex path including turn around rollers 50 to alignment rollers 55 and hence to timing rollers 17 as shown in FIG. 3. At this point, a transparent laminating sheet 101 is fed from one of supply hoppers 25 or 26 also to feed rollers 17 and on top of receiving sheet 100 as shown in FIG. 3 to form a sandwich. Once transparent laminating sheet 101 has been positioned on top of the toner image on receiving sheet 100 the timing rollers 17 are energized and the sandwich is conveyed back through the transfer station to fuser 40 and into the output tray 41, as in FIG. 2.

If the toner image covers a substantial portion of the receiving sheet, the adhesive tendency of the toner itself may be sufficient to hold the two receving sheets together once it has been softened by the fuser 40. However, most color transparencies do not contain adequate toner to reliably hold the sheets together. Accordingly, it is preferable to have a side of at least one of the sheets coated with a thermoplastic having a glass transition or melting temperature similar to that of the toner. This thermoplastic has a tendency to optically encapsulate the toner when heated in the fusing station which further reduces the tendency of the toner to scatter light.

If only one sheet is to have the thermoplastic coating, then the sheets can not be identical. For convenience the receiving sheets can be fed from a stack in one supply hopper and the laminating sheets from a stack in the other supply hopper. Alternatively, the sheets may be alternated prior to loading as a single stack in one of the supply hoppers.

If both sheets contain the thermoplastic then the sheets can be identical. Note however that the FIG. 2 embodiment requires that the receiving sheet have the thermoplastic facing down in the supply hopper while the laminating sheet would have the thermoplastic facing up. However, the embodiment according to FIG. 3 inverts the first receiving sheet in the duplex path and therefore is operative with a supply of receiving and laminating sheets in which all sheets have their thermoplastic surfaces facing downward in the stack.

With this invention, lamination of a toner image on a receiving sheet is provided without adding additional structure to the copy sheet path in a copier or printer and without manually handling the receiving sheets between the initial transfer and the laminating step.

The invention has been described in detail with particular reference to preferred embodiments thereof, but it will be understood that variations and modifications can be effected within the spirit and scope of the invention. For example, the invention was designed to improve the projection of color transparencies. But, it can also be used with opaque receiving sheets to protect and better fix a high quality image.

We claim:

1. A method of forming a toner image laminated between a receiving sheet and a laminating sheet, said method comprising:

feeding a receiving sheet from a sheet supply means, which supply means can comprise one or more stacks of sheets, through a path to a transfer means, transferring a toner image to said receiving sheet at said transfer means, feeding a transparent laminating sheet from the same sheet supply means through the same path to said transfer means and into overlying contact with the same toner image on said receiving sheet to form a sandwich, and passing said sandwich through a fuser to laminate said toner image between said sheets.

2. The method according to claim 1 wherein said receiving sheet is transparent and said toner image is a color toner image.

3. The method according to claim 2 wherein said receiving sheet and said laminating sheets are the same and are fed from a single stack in said sheet supply.

4. The method according to claim 3 wherein said sheets have a layer of heat softenable thermoplastic which layers engage the toner image and soften while passing through the fuser, encapsulating the toner image.

5. The method according to claim 1 wherein said laminating sheet has a layer of heat softenable thermoplastic, which layer engages said toner image and softens while passing through the fuser, encapsulating the toner image.

6. The method according to claim 1 wherein said receiving sheet and laminating sheet are different and said receiving sheet is fed from a first stack in said sheet supply means containing only receiving sheets and said laminating sheet is fed from a second stack in said sheet supply means containing only laminating sheets.

7. The method according to claim 1 wherein said receiving sheet and laminating sheet are different and are fed from a single stack in which said sheets are arranged alternatively.

8. Reproduction apparatus comprising:

an image-bearing member, means for forming a series of toner images of different color on said image-bearing member, means for holding a supply of receiving sheets and of transparent laminating sheets, a transfer drum, said transfer drum including means for attaching a receiving sheet to said drum for repeated presentation to said series of toner images of different color to transfer said images to said receiving sheet in registry to form a multicolor toner image on said receiving sheet, means for fusing a toner image to a receiving sheet, means for feeding a receiving sheet through a path from said supply to said transfer drum to receive said multicolor toner image thereon and thereafter to said fusing means, and means for feeding a transparent laminating sheet from said supply into contact with said multicolor toner image on said receiving sheet to form a sandwich with the multicolor toner image between said sheets, and for feeding said sandwich through said fuser to laminate said multicolor toner image between said sheets.

9. Reproduction apparatus according to claim 8 wherein said means for holding a supply of receiving sheets and of transparent laminating sheets includes at least one supply hopper that can be used to store receiving sheets in a first mode of operation and to store laminating sheets in a second mode operation.

10. Reproduction apparatus according to claim 8 wherein said means for feeding said transparent laminating sheet includes means for feeding said transparent laminating sheet through at least a portion of the same path as said receiving sheet is fed to said transfer station, and into engagement with said receiving sheet while said receiving sheet is at least partially secured by said transfer drum.

11. Reproduction apparatus comprising:

an image-bearing member, means for forming a toner image on said image-bearing member, means for holding a supply of receiving sheets and of transparent laminating sheets, means for transferring a toner image from said image-bearing member to a receive sheet, means for fusing a toner image to a receiving sheet, means for feeding a receiving sheet through a path from said supply to said transfer means to receive a toner image thereon and thereafter through said fusing means, means for feeding said receiving sheet from said fuser to a position upstream of said transfer station, and means for feeding a transparent laminating sheet into contact with said toner image after said receiving sheet has been returned to said upstream position to form a sandwich with said toner image between said sheets, and for feeding said sandwich back through said path through said fuser to laminate said toner image between said sheets.

12. Apparatus according to claim 11 wherein said means for feeding said receiving sheet to a position upstream includes means for inverting said receiving sheet to position said sheet back in its original path with the toner image on a side of said sheet which side is reversed from its orientation when orginally fed to said transfer station.

* * * * *